US009459048B2

(12) United States Patent
Nakashima

(10) Patent No.: US 9,459,048 B2
(45) Date of Patent: Oct. 4, 2016

(54) METAL MELTING FURNACE

(71) Applicant: KABUSHIKI KAISHA MEICHU, Nagoya-shi, Aichi-ken (JP)

(72) Inventor: Mitsukane Nakashima, Nagoya (JP)

(73) Assignee: KABUSHIKI KAISHA MEICHU, Aichi-ken (JP)

( * ) Notice: Subject to any disclaimer, the term of this patent is extended or adjusted under 35 U.S.C. 154(b) by 232 days.

(21) Appl. No.: 14/254,283

(22) Filed: Apr. 16, 2014

(65) Prior Publication Data

US 2015/0042024 A1 Feb. 12, 2015

(30) Foreign Application Priority Data

Aug. 8, 2013 (JP) ..... 2013-165381

(51) Int. Cl.
*F27D 17/00* (2006.01)
*F27B 3/04* (2006.01)
*F27B 3/20* (2006.01)

(52) U.S. Cl.
CPC ..... *F27D 17/004* (2013.01); *F27B 3/045* (2013.01); *F27B 3/205* (2013.01)

(58) Field of Classification Search
CPC ..... F27D 3/145; F27D 5/00; Y10S 266/90
USPC ..... 266/242, 900, 903
See application file for complete search history.

(56) References Cited

U.S. PATENT DOCUMENTS 4,353,532 A * 10/1982 Jay ..... C22B 21/0084 266/242
7,235,210 B2 6/2007 Nakashima
2015/0042024 A1* 2/2015 Nakashima ..... F27D 17/004 266/155

FOREIGN PATENT DOCUMENTS

| | | | |
|---|---|---|---|
| JP | 52-8907 | A | 1/1977 |
| JP | 59-32289 | U | 2/1984 |
| JP | 60-235985 | A | 11/1985 |
| JP | 11-14263 | A | 1/1999 |
| JP | 4352026 | B2 | 10/2009 |

* cited by examiner

*Primary Examiner* — Scott Kastler
(74) *Attorney, Agent, or Firm* — Cheng Law Group, PLLC

(57) ABSTRACT

A metal melting furnace which effectively melts a melting material and holds the temperature of the molten material to reduce fuel. The metal melting furnace has a material charging port and a flue at its top and a melting chamber with a heating plate which melts a melting material charged from the material charging port at its bottom. A heating burner is disposed at a bottom side of the heating plate of the melting chamber and is used to melt the melting material on the heating plate. Exhaust gas of the heating burner, which circulates through the exhaust gas channel, is used to preheat the melting material of the flue. At a bottom side of the heating burner of the melting chamber, a molten material holding section into which molten material flows to be stored is formed. The heating burner holds the temperature of the molten material.

7 Claims, 11 Drawing Sheets

METAL MELTING FURNACE

BACKGROUND OF THE INVENTION

1. Field of the Invention

The present invention relates to a metal melting furnace which has a material charging port and flue at its top and is provided with a melting chamber at which a heating plate which melts material to be melted ("melting material") which was charged from the material charging port at its bottom.

2. Description of the Related Art

The inventor first proposed the metal melting furnace 100 which is illustrated in FIGS. 10 and 11. This metal melting furnace 100 is provided at its top with a melting chamber 120 which has a material charging port 121 and flue 122, is formed with a combustion chamber 130 which is provided with a melting burner 135 at a bottom side of the melting chamber 120, has a heating plate 140 disposed at an upper part of the combustion chamber 130, is formed with an exhaust gas channel 125 from the combustion chamber 130 so as to open at the melting chamber 120, and is configured to use the melting burner 135 to melt the melting material which was charged from the material charging port 121 through the heating plate 140 and makes the molten material M flow down to the molten material holding section 150 (for example, see Japanese Patent No. 4352026).

In the figures, reference notation 111 indicates a furnace wall, 112 a work inspection hole which is formed in the furnace wall 111, 113 a door of the same, 114 an inclined floor of molten material which was melted on the heating plate 140, 115 a melting material holding member which is disposed at the material charging port 121, 116 a flange section which is provided at an upper part of the melting material holding member 115, 152 a work inspection hole of the molten material holding section 150, 153 a door of the same, and 160 a molten material processing section which is defined by a partition section 165 at the molten material holding section 150, 166 a molten material communicating section which is formed at the lower part of the partition section 165, 167 an exhaust gas channel which is formed at the upper part of the partition section 165, and 170 a molten material discharge section.

On the other hand, in this type of metal melting furnace 100, the fuel consumptions of the various burners which are used when melting the melting material and holding the temperature of the molten material have a great effect on the melting costs. Therefore, more efficiently melting the melting material and holding the temperature of the molten material so as to reduce the fuel consumption compared with the past has been strongly demand.

As related art, see the above Japanese Patent No. 4352026.

SUMMARY OF INVENTION

The present invention was made in consideration of this point and proposes a metal melting furnace which can more effectively melt the melting material and hold the temperature of the molten material so as reduce the fuel economy compared with the past.

That is, the first aspect of the invention relates to a metal melting furnace which has a material charging port and a flue at its top and is provided with a melting chamber which is provided with a heating plate which melts a melting material which is charged from the material charging port at its bottom, the metal melting furnace characterized in that a heating burner is disposed at a bottom side of the heating plate of the melting chamber, the heating burner is used to melt the melting material on the heating plate, and exhaust gas of the heating burner which circulates through the exhaust gas channel is used to preheat the melting material of the flue and in that at a bottom side of the heating burner of the melting chamber, a molten material holding section to which molten material which was melted on the heating plate flows down into to be stored is formed, and the heating burner is used to hold the temperature of the molten material.

The second aspect of the invention relates to a metal melting furnace according to the first aspect, wherein between an inclined floor of the molten material which was melted on the heating plate and the molten material holding section, a molten material processing section which has a partition section which is provided with a molten material communicating section at a lower part is formed and wherein the top surface of the molten material which was melted at the melting chamber is prevented from directly flowing into the molten material holding section.

The third aspect of the invention of claim 3 relates to a metal melting furnace according, to the first aspect, wherein a discharge section which communicates with the molten material holding section is disposed and wherein the discharge section is provided with an auxiliary heater for holding the temperature of the molten material.

The fourth aspect of the invention relates to a metal melting furnace according to the first aspect, wherein a second heating burner is disposed for heating the melting material on the heating plate at a top side of the heating plate of the melting chamber.

The fifth aspect of the invention relates to a metal melting furnace according to the first aspect, wherein a molten material holding chamber which communicates with the molten material holding section, stores the molten material, and uses a holding burner to hold the temperature of the molten material is provided.

The sixth aspect of the invention relates to a metal melting furnace according to the fifth aspect, wherein the partition section at the melting chamber side which defines the molten material holding chamber is formed at a lower part with a molten material communicating section which communicates with the molten material holding section and is formed at an upper part with a second exhaust gas channel which circulates exhaust gas of the holding burner of the molten material holding chamber to the melting chamber.

The seventh aspect of the invention relates to a metal melting furnace according to the fifth aspect, wherein a discharge section which communicates with the molten material holding chamber is provided and wherein the discharge section is provided with an auxiliary heater is provided for holding the temperature of the molten material.

Summarizing the advantageous effects of the present invention, since the metal melting furnace according to the first aspect of the invention is a metal melting furnace which has a material charging port and a flue at its top and is provided with a melting chamber which is provided with a heating plate which melts a melting material which is charged from the material charging port at its bottom, the metal melting furnace characterized in that a heating burner is disposed at a bottom side of the heating plate of the melting chamber, the heating burner is used to melt the melting material on the heating plate, and exhaust gas of the heating burner which circulates through the exhaust gas channel is used to preheat the melting material of the flue and in that at a bottom side of the heating, burner of the melting chamber, a molten material holding section to which molten material which was melted on the heating plate flows down into to be stored is formed, and the heating burner is used to hold the temperature of the molten material, it becomes possible for a single heating burner to simultaneously preheat the melting material on the heating plate and the molten material which is stored in the molten material holding section and therefore possible to greatly reduce the fuel consumption during operation.

Since the second aspect of the invention comprises the first aspect wherein between an inclined floor of the molten material which was melted on the heating plate and the molten material holding section, a molten material processing section which has a partition section which is provided with a molten material communicating section at a lower part is formed and wherein the top surface of the molten material which was melted at the melting chamber is prevented from directly flowing into the molten material holding section, it is possible to raise the cleanliness of the molten material in the molten material holding section to hold the quality high, and the work of removing impurities is simplified, so the work efficiency is improved.

Since the third aspect of the invention comprises the first aspect wherein a discharge section which communicates with the molten material holding section is disposed and wherein the discharge section is provided with an auxiliary heater for holding the temperature of the molten material, oxidation of the molten material is suppressed and therefore the metal loss is reduced and, further, temperature control of the molten material becomes easy, so the burden on the heating burner is lightened to reduce the fuel consumption.

Since the fourth aspect of the invention comprises the first aspect wherein a second heating burner is disposed for heating the melting material on the heating plate at a top side of the heating plate of the melting chamber, the burden on the heating burner can be lightened and the occurrence of unmelted or half-melted materials can be more effectively prevented.

Since the fifth aspect of the invention comprises the first aspect wherein a molten material holding chamber which communicates with the molten material holding section, stores the molten material, and uses a holding burner to hold the temperature of the molten material is provided, it is possible to efficiently hold the temperature even when a large amount of molten material is stored and possible to reduce the fuel consumption during operation.

Since the sixth aspect of the invention comprises the fifth aspect wherein the partition section at the melting chamber side which defines the molten material holding chamber is formed at a lower part with a molten material communicating section which communicates with the molten material holding section and is formed at an upper part with a second exhaust gas channel which circulates exhaust gas of the holding burner of the molten material holding chamber to the melting chamber, it is possible to raise the cleanliness of the molten material in the molten material holding section to hold the quality high, the work of removing impurities is simplified and the work efficiency is improved, and the burden on the heating burner can be lightened and fuel consumption can be reduced.

Since the seventh aspect of the invention comprises the fifth aspect wherein a discharge section which communicates with the molten material holding chamber is provided and wherein the discharge section is provided with an auxiliary heater is provided for holding the temperature of the molten material, oxidation of the molten material is suppressed and therefore the metal loss is reduced and further, temperature control of the molten material becomes easy and the burden on the heating burner and holding burner is lightened to reduce the fuel consumption.

DESCRIPTION OF THE PREFERRED EMBODIMENTS

Figure 1:
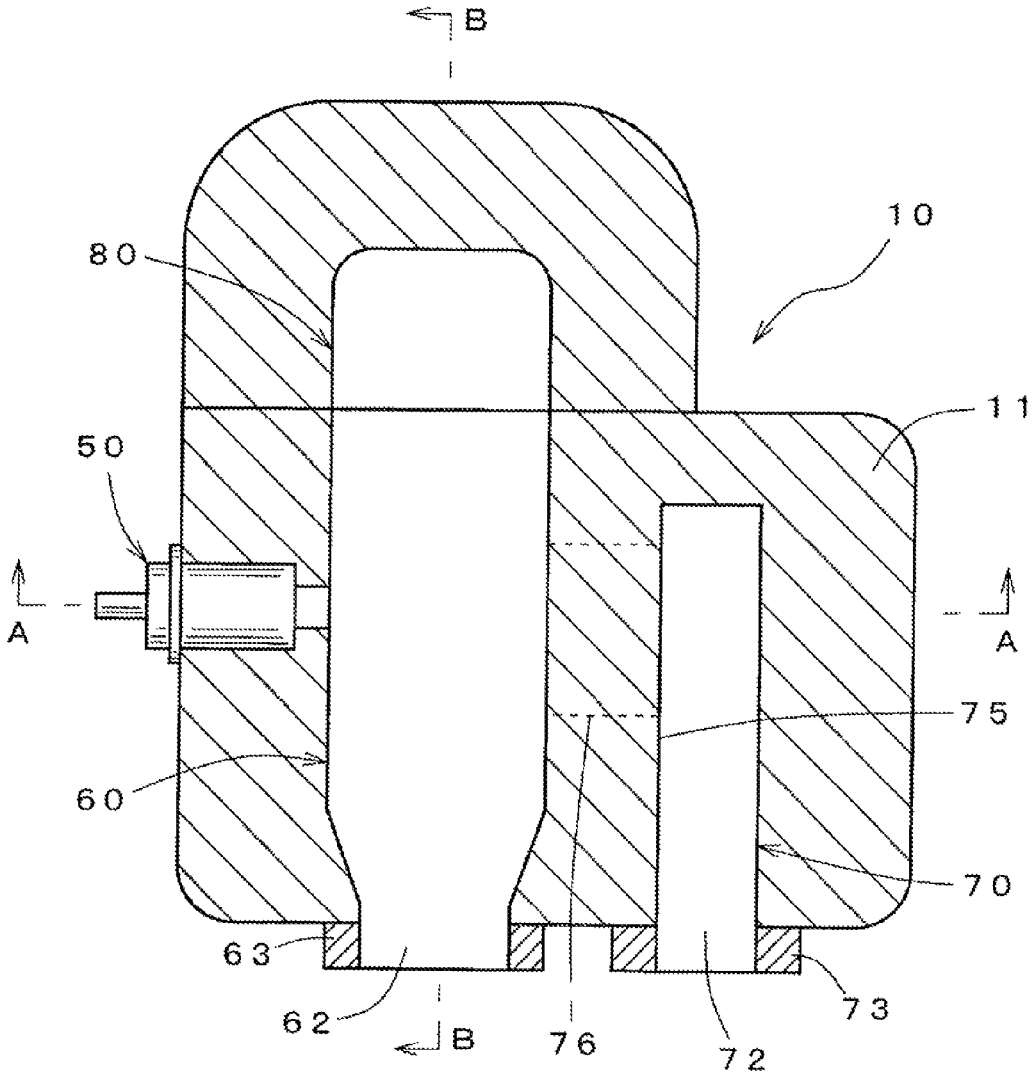
FIG. 1 is an overall schematic cross-sectional view of a metal melting furnace according to a first embodiment of the present invention.
Figure 2:
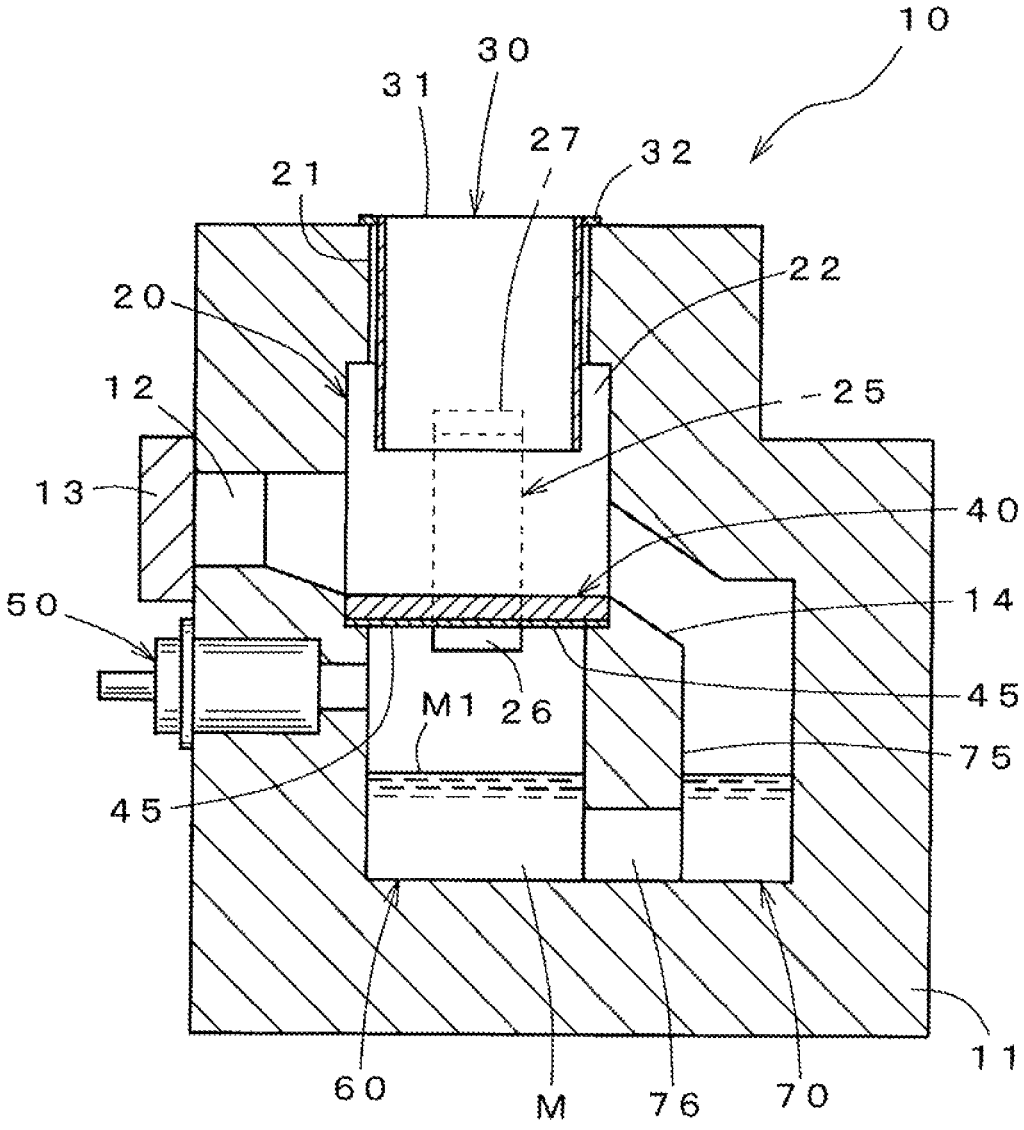
FIG. 2 is a longitudinal cross-sectional view along the line A-A of FIG. 1.
Figure 3:
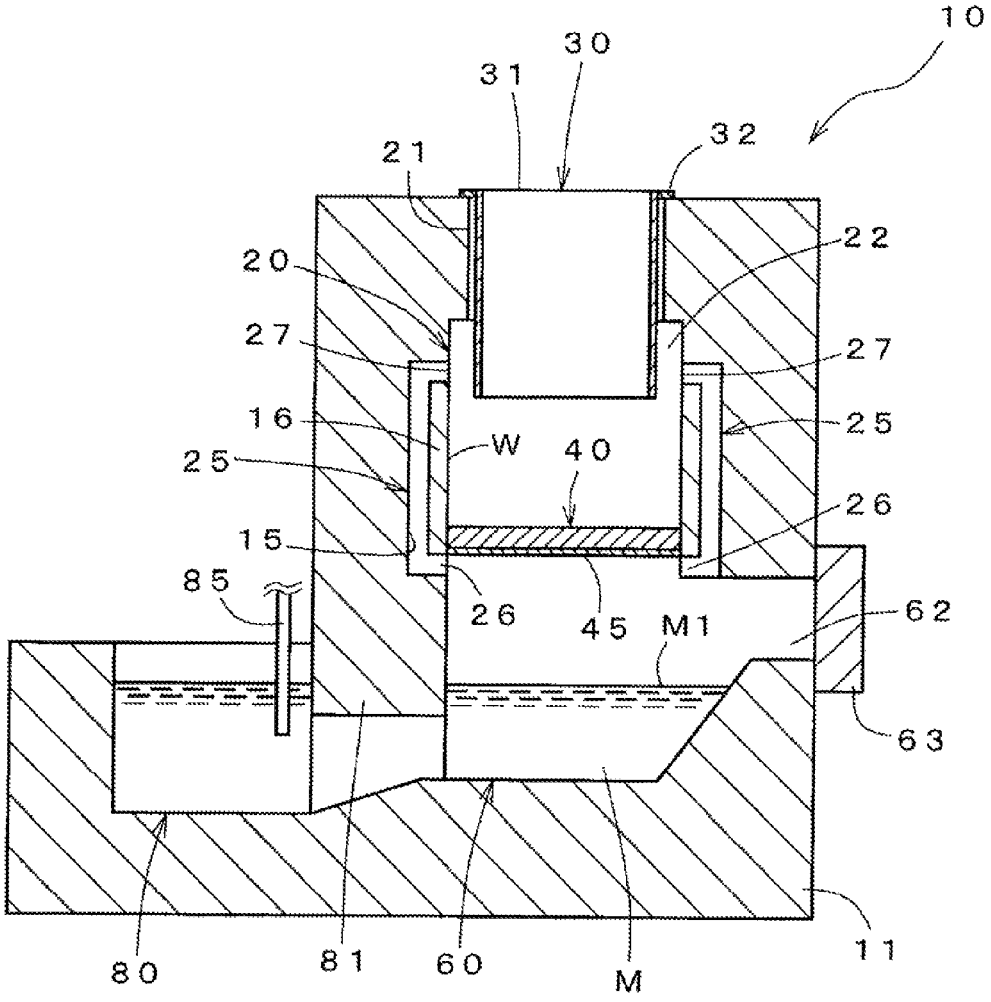
FIG. 3 is a longitudinal cross-sectional view along the line B-B of FIG. 1.

A metal melting furnace 10 according to one embodiment of the present invention which is shown in FIG. 1 to FIG. 3 is a so-called "local" melting furnace which melts and holds aluminum for aluminum casting. This is generally called a "dry hearth furnace". It has a material charging port 21 and flue 22 at its top and is provided with a melting chamber 20 in which a heating plate 40 which melts the melting material which was charged from the material charging port 21 is disposed at its bottom. In the figures, reference notation 11 indicates a furnace main body which forms the melting chamber 20, 12 indicates a work inspection hole which is formed in the furnace main body 11, 13 is a door of the same, 14 is an inclined floor of the molten material which was melted on the heating plate 40, and M is a molten material obtained by melting the melting material.

The melting chamber 20, as shown in FIGS. 2 and 3, is a space for melting the charged melting material and has an exhaust gas channel 25 which is formed inside of side walls W, a melting material holding member 30 which is disposed at the material charging port 21 at the upper part, a heating plate 40 which is disposed at a bottom side of the material charging port 21, and a heating burner 50 which is disposed at the bottom side of the heating plate 40.

The exhaust gas channel 25, as shown in FIGS. 2 and 3, is formed inside the side walls W of the melting chamber 20 so as to connect an inlet 26 which opens at a bottom side of the heating plate 40 at which the heating burner 50 is disposed to an outlet 27 which opens at the flue 22 side. In this exhaust gas channel 25, exhaust gas of the later explained heating burner 50 is made to flow out to the flue 22. The exhaust gas channel 25 of the present embodiment is made approximately U-shape in cross-section and discharges the exhaust gas due the heating burner 50 to preheat the inside of the flue 22. Further, as shown in FIG. 3, by forming a plurality of exhaust gas channels 25 (two in this example), it is possible to efficiently preheat the inside of the flue 22.

This exhaust gas channel 25, as shown in FIG. 3, is configured by a groove section 15 which is formed in a side surface of the furnace main body 11 and a side wall member 16. An outlet 27 is formed at the upper part of the side wall member 16. Due to this, the exhaust gas channel 25 can be simply and reliably formed and the manufacturing costs can also be reduced. Further, in the exhaust gas channel 25, the exhaust gas which runs through its inside can be used to preheat the inside of the flue 22 through the side wall member 16 and simultaneously the exhaust gas which flows out from the outlet 27 can be used to preheat the inside of the flue 22, so it becomes possible to extremely efficiently preheat the material as a whole to melt it. In particular, if making the side wall member 16 of the exhaust gas channel 25 silicon carbide (SiC), silicon nitride ($Si_3N_4$), or another material which is good in heat conductivity and excellent in heat resistance, it is possible to better improve the preheating effect by the side wall member 16.

The melting material holding member 30, as shown in FIGS. 2 and 3, is comprised of a tubular member with a lower part which opens inside of the melting chamber 20 from the flue 22. It holds the melting material which is charged from the top opening part 31 to avoid contact between the side walls of the inside of the melting chamber 20 and melting material. Further, the outlet 27 of the exhaust gas channel 25 opens toward the side surface of the melting material holding member 30, so the exhaust gas which flows out from the exhaust gas channel 25 preheats the melting material holding member 30 from the outside. Also, when the exhaust gas is discharged from the inside of the flue 22 to the outside of the furnace, it preheats the melting material holding member 30 from the inside. In this way, it is possible to avoid contact between the side walls W at the inside of the melting chamber 20 and the melting material and preheat both the inside and outside of the holding member 30, so it becomes possible to preheat the melting material as a whole, improve the preheating efficiency, and raise the productivity. Further, it is possible to prevent unmelted material from sticking to and remaining at the inside of the flue 22, lighten the complicated and difficult work of removing and cleaning the unmelted material, and prevent damage to the furnace main body 11 due to the unmelted material solidifying at the furnace main body 11 to raise the durability. Note that, reference notation 32 of the figures shows the flange section of the melting material holding member 30 which covers and protects the opening edge of the material charging port 21.

The material of the melting material holding member 30 is a part which can be heated from the outside. The melting material is charged and exposed to a 900° C. or more high temperature there. Therefore, a material which is good in heat conductivity and excellent in heat resistance and impact resistance is preferably used. For example, it is a thickness 10 mm or so stainless steel material (heat-resistant cast steel) which is coated with alumina ($Al_2O_3$) at its outer surface side so as to prevent oxidation and improve the durability.

The heating plate 40, as shown in FIGS. 2 and 3, is formed into a flat shape, is placed on a mount section 23 below the melting material holding member 30, and is preheated by the combustion heat of the heating burner 50 which is explained later, so is configured to melt the melting material from the bottom side. In this heating plate 40, a heat resistant plate which is excellent in heat conductivity which enables the combustion heat of the heating burner 50 to be transferred to the melting material more efficiently and is able to withstand the combustion heat (about 1000° C. high temperature) is used. As the material of the heating plate, for example, silicon carbide (SiC), silicon nitride ($Si_3N_4$), etc. is suitably used. Further, at the heating plate 40, a reinforcing plate 45 of a stainless steel material (heat-resistant cast steel) can be provided at the back surface to improve the strength. Note that, while not shown, by forming a plurality of small holes in the reinforcing plate 45, it is possible to make transfer of heat to the heating plate 40 easier.

The heating burner 50, as shown in FIGS. 1 and 2, is disposed at the bottom side of the heating plate 40 of the melting chamber 20 and melts the melting material on the heating plate 40 through the heating plate 40. The exhaust gas which circulates through the exhaust gas channel 25 is used to preheat the melting material in the flue 22. In the heating burner 50 of this embodiment, the burner flame is made about 1100 to 1200° C., the bottom side of the heating plate 40 is heated to about 1000° C., and the exhaust gas is made to flow out from the exhaust gas channel 25 to preheat the inside of the flue 22 to about 900 to 950° C.

Further, the heating burner 50 is separated from the melting material by the heating plate 40, so the area around the heating burner 50 and the inside of the same is free of sherbet-like half-melted material splattering on them and sticking as oxides, the work of removal of the oxides becomes unnecessary, and the work of cleaning the inside of the furnace can be shortened.

At the metal melting furnace 10, as shown in FIG. 1 to FIG. 3, a molten material holding section 60 is formed at the bottom side of the heating burner 50 of the melting chamber 20. In the figures, reference notation 62 indicates a work inspection hole of the molten material holding section 60, and 63 indicates a door of the same.

This molten material holding section 60, as shown in FIGS. 2 and 3, is a space which communicates with the melting chamber 20 through the inclined floor 14 at which molten material flows down from the heating plate 40. It corresponds to part of the space which the heating burner 50 heats at the bottom side of the heating plate 40. The molten material M which was melted on the heating plate 40 flows down to it where it is then stored. Further, the molten material holding section 60 is configured to use the heating burner 50 which heats and melts the melting material on the heating plate 40 to maintain the temperature of the stored molten material M. That is, the burner flame of the heating burner 50 heats the space between the heating plate 40 and the top surface M1 of the molten material M at its bottom side, so the melting material on the heating plate 40 is preheated through the heating plate 40 and the exhaust gas channel 25 and the molten material M which is stored at the molten material holding section 60 is preheated to hold it at a predetermined temperature. Note that, the top surface M1 of the molten material M which is stored at the molten material holding section 60 is positioned below the heating burner 50 in this configuration. This is so as to avoid the deposition of molten material M around and inside the heating burner 50 to make the removal work or other complicated cleaning work unnecessary. Along with this, if the burner flame of the heating burner 50 is kept from directly striking the top surface M1 of the molten material M, it is possible to suppress oxidation of the molten material M and reduce the metal loss.

Further, in the metal melting furnace 10 of this embodiment, as shown in FIGS. 1 and 2, between the inclined floor 14 and molten material holding section 60, a molten material processing section 70 which has a partition section 75 which is provided with a molten material communicating section 76 is formed at the lower part and is configured so that the top surface M1 of the molten material M which was melted at the melting chamber 20 does not directly flow into the molten material holding section 60. The molten material processing section 70 once stores the molten material M from the inclined floor 14 while the partition section 75 prevents it from directly flowing into the molten material holding section 60 whereby oxides of various metals and other impurities which form along with melting of the melting material collect at the top surface M1 of the molten material M before diffusing inside the molten material M. Due to this, impure molten material is blocked by the partition section 75 and does not flow into the molten material holding section 60. Only clean molten material M flows through the molten material communicating section 76 of the lower part of the partition section 75 to the molten material holding section 60. Therefore, it is possible to greatly reduce the inflow of impurities to the molten material holding section 60 and raise the cleanliness of the molten material M inside of the molten material holding section 60 to hold the quality high and, further, the work of removal of the impurities is simplified, so the work efficiency rises. Further, reference notation 72 in the figures indicates a work inspection hole of the molten material processing section 70, while 73 indicates a door of the same.

Furthermore, in the metal melting furnace 10, as shown in FIGS. 1 and 3, a discharge section 80 which communicates with the molten material holding section 60 is disposed. The discharge section 80 is provided with an auxiliary heater 85 for holding the temperature of the molten material M. As the auxiliary heater 85, a known immersion heater which can hold the temperature of the molten material M without utilizing the combustion heat is suitably used. By using the auxiliary heater 85 to hold the temperature of the molten material M, it becomes possible to hold the temperature of the molten material M without allowing it to burn, so oxidation of the molten material M can be suppressed and metal loss can be reduced. In addition, temperature control of the molten material M becomes easy and the burden of the heating burner 50 is lightened to reduce the fuel consumption. Note that, between the molten material holding section 60 and the discharge section 80, a discharge side partition section 81 which is configured so that the top surface M1 of the molten material M does not directly flow into the discharge section 80 is provided so as to prevent the inflow of impure molten material into the discharge section 80 and more reliably cause clean molten material M to flow in.

In the metal melting furnace 10 according to the above first embodiment, the heating burner 50 is used to simultaneously preheat the melting material on the heating plate 40 and the molten material M which is stored in the molten material holding section 60 and thereby enable a single heating burner 50 to be jointly used as the burner for heating and melting the melting material on the heating plate 40 and the burner for holding the temperature of the molten material M of the molten material holding section 60. For this reason, it is possible to greatly reduce the fuel consumption during operation of the metal melting furnace 10. In this embodiment, the fuel consumption for holding and raising the temperature was improved about 75% compared with a conventional metal melting furnace.

Further, the molten material holding section 60 is a space at the bottom side of the heating plate 40 at which the heating burner 50 is disposed, so the melting furnace 10 can be made smaller, space can be saved, and the manufacturing costs can be reduced.

Next, FIG. 4 to FIG. 9 will be used to explain metal melting furnaces according to other embodiments. In the following embodiments, reference notations the same as the first embodiment express the same constitutions and explanations will be omitted.

Figure 4:
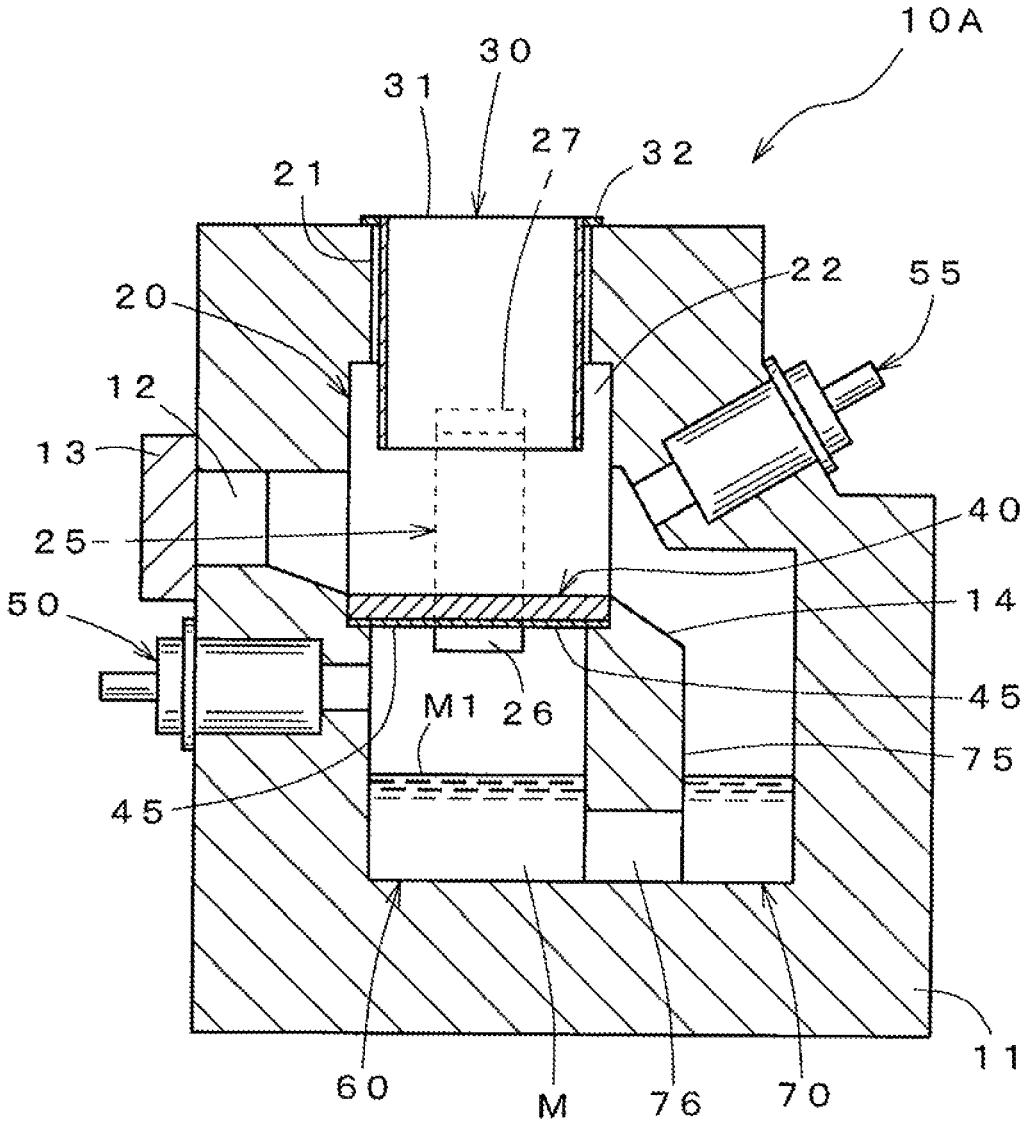
FIG. 4 is a longitudinal cross-sectional view of a metal melting furnace according to a second embodiment.

In a metal melting furnace 10A according to a second embodiment which is shown in FIG. 4, a second heating burner 55 is disposed for heating the melting material on the heating plate 40 at the top side of the heating plate 40 of the melting chamber 20. The second heating burner 55 is configured to make the burner flame directly contact the melting material of the heating plate 40 so as to heat and melt it on an auxiliary basis. Due to this, it becomes possible to more efficiently preheat the melting material together with the heating burner 50 and possible to lighten the burden on the heating burner 50 and more effectively prevent the occurrence of unmelted or half-melted materials.

Further, while not shown, in the metal melting furnace 10A of the second embodiment, in the same way as the metal melting furnace 10, a discharge section 80 which communicates with the molten material holding section 60 is disposed. In accordance with need, the discharge section 80 is provided with an auxiliary heater 85 for holding the temperature of the molten material M.

Figure 5:
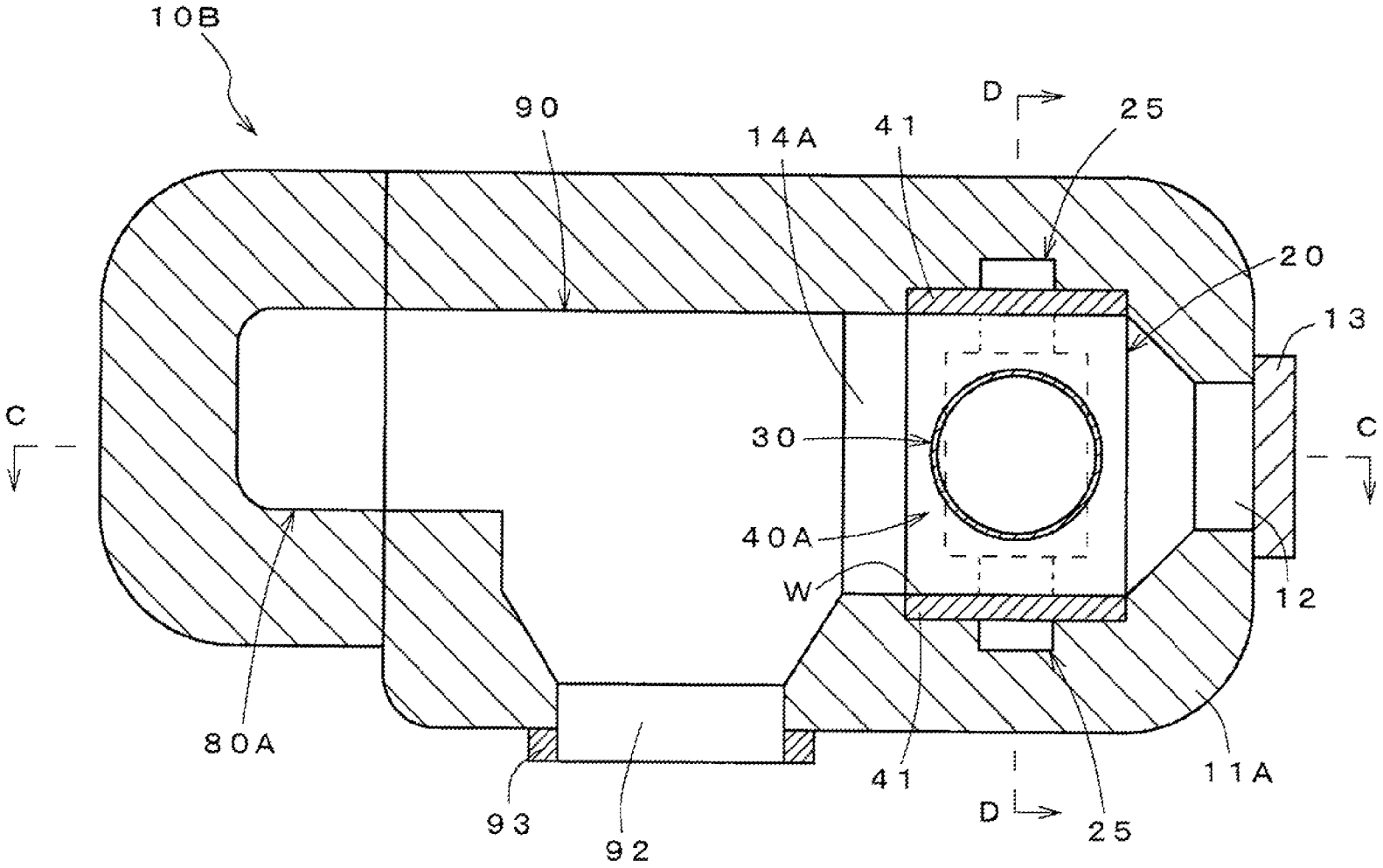
FIG. 5 is an overall schematic cross-sectional view of a metal melting furnace according to a third embodiment.
Figure 6:
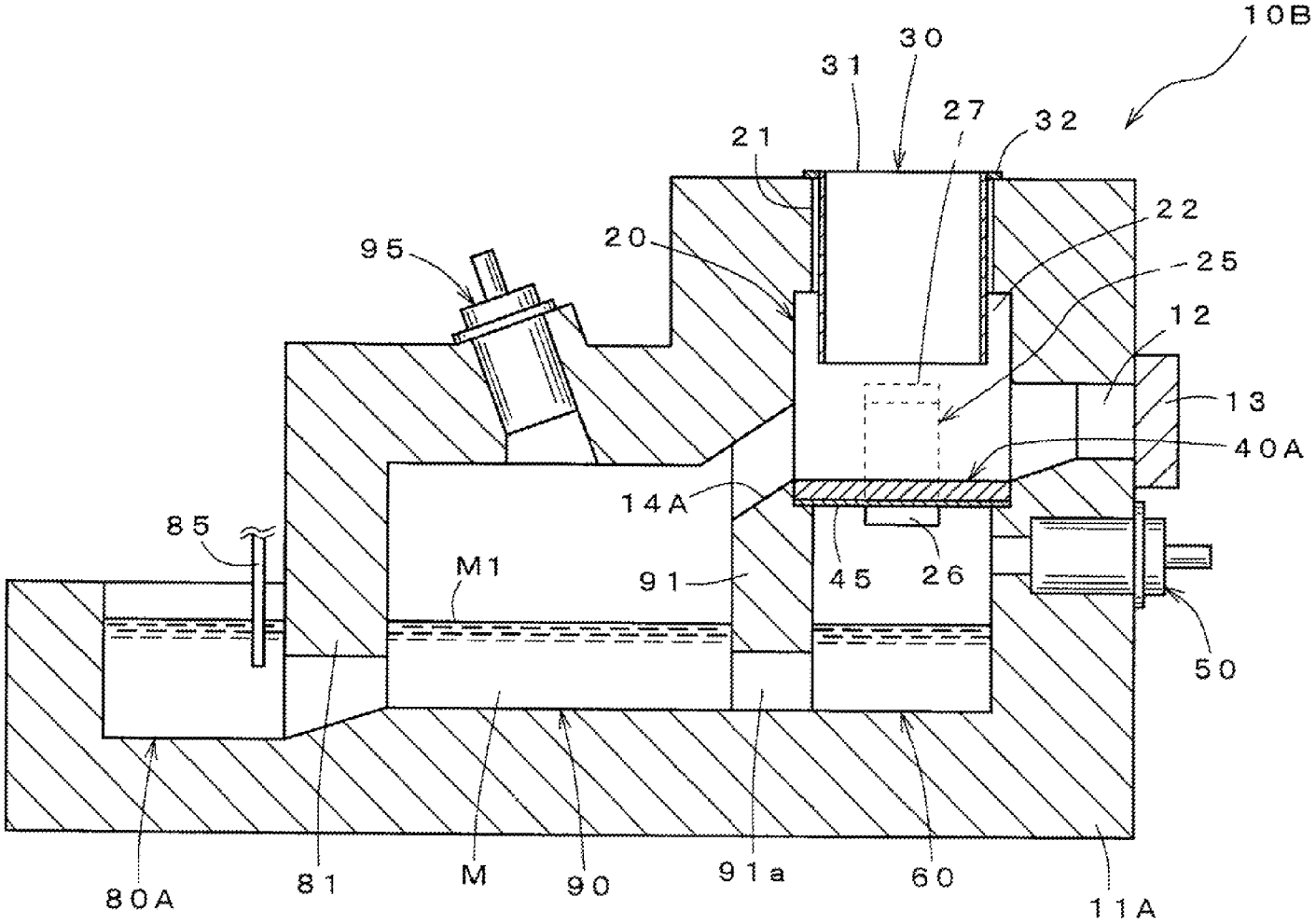
FIG. 6 is a longitudinal cross-sectional view along the line C-C of FIG. 5.
Figure 7:
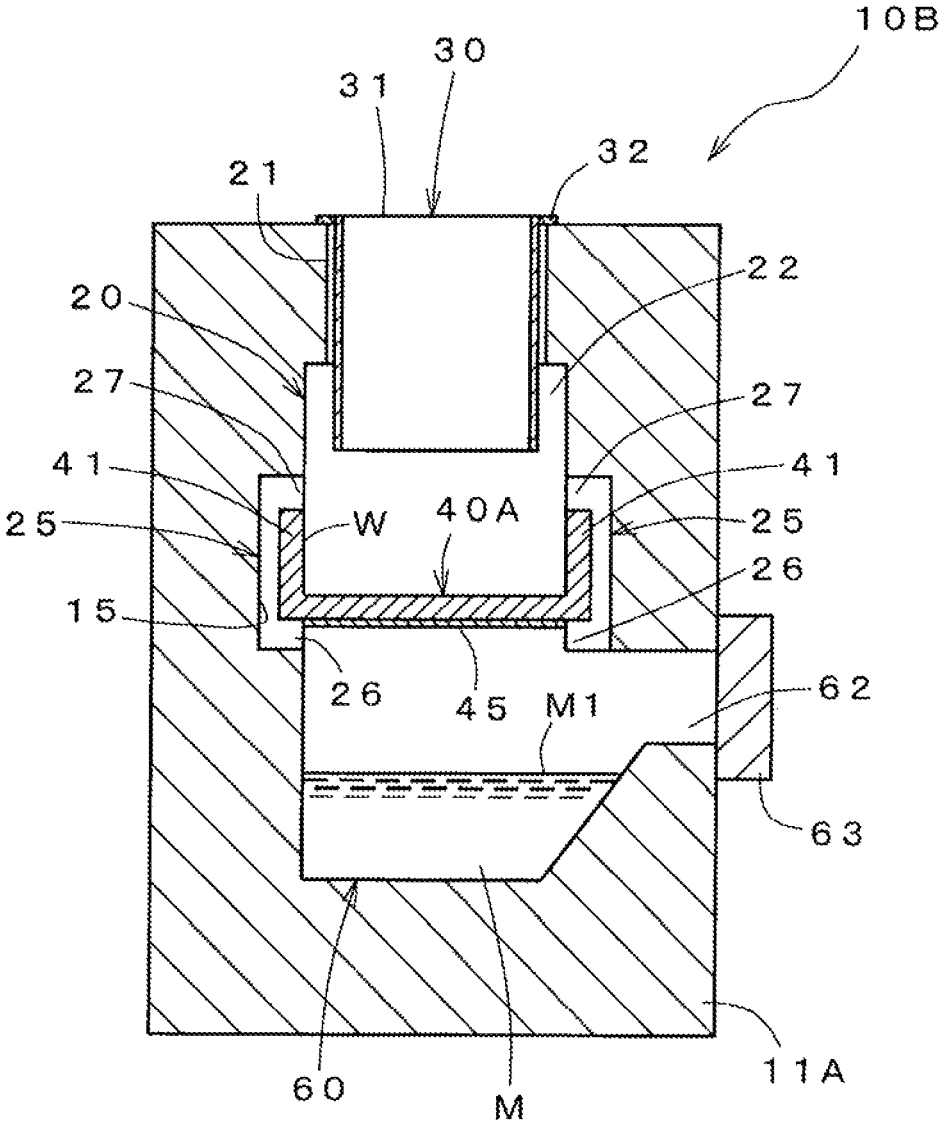
FIG. 7 is a longitudinal cross-sectional view along the line D-D of FIG. 5.

A metal melting furnace 10B according to a third embodiment which is shown in FIG. 5 to FIG. 7 is provided with a molten material holding chamber 9 which communicates with the molten material holding section 60. In the figures, reference notation 11A indicates a furnace main body which forms the combustion chamber 20 and molten material holding chamber 90, 92 a work inspection hole of the molten material holding chamber 90, and 93 a door of the same.

The molten material holding chamber 90 is a space which stores a large amount of molten material M and can hold the temperature of the molten material M by a holding burner 95. It is communicated with the molten material holding section 60 through a holding chamber partition section 91 which has a molten material communicating section 91*a* at the lower part. This molten material holding chamber 90 is configured so that the holding chamber partition section 91 keeps the top surface M1 of the molten material M inside the molten material holding section 60 from flowing into the molten material holding chamber 90, so it is possible to prevent the inflow of impure molten material from the molten material holding section 60. Further, the stored molten material M is preheated by the heating burner 50 in the molten material holding section 60 and is preheated by the holding burner 95 in the molten material holding chamber 90. For this reason, the molten material M is preheated at both the molten material holding section 60 and the molten material holding chamber 90, the molten material M can be efficiently held in temperature even when a large amount of molten material M is stored, and the fuel consumption during operation can be reduced.

The molten material holding chamber 90 of the embodiment is communicated with the flue 22 of the melting chamber 20 through an inclined floor 14A of the molten material M which was melted on the heating plate 40. For this reason, the exhaust gas of the holding burner 95 for holding the temperature of the molten material M in the molten material holding chamber 90 runs over the inclined floor 14A to circulate through the inside of the melting chamber 20 and be discharged to the outside from the material charging port 21 serving also as an exhaust port. Due to this, the exhaust gas from the molten material holding chamber 90 is circulated through the entire furnace so can not only hold the temperature of the molten material M inside the molten material holding chamber 90, but can also preheat the melting material on the heating plate 40 on an auxiliary basis to enable it to be more efficiently heated and melted and enable the burden on the heating burner 50 to be lightened and the fuel efficiency to be improved. Note that, the molten material M which is melted on the heating plate 40 flows down to the molten material holding chamber 90 and flows into the molten material holding section 60 through the molten material communicating section 91*a*. Further, the inclined floor 14A is formed at the upper part of the holding chamber partition section 91.

In the metal melting furnace 10B of the third embodiment, as shown in FIG. 7, a heating plate 40A of an approximately U-shape when viewed from the side is used. In the U-shaped heating plate 40A, standing wall sections 41 and 41 may also be configured as side walls W of the melting chamber 20. For this reason, it is possible to configure the melting chamber 20 extremely simply and reliably and possible to reduce the manufacturing costs. Further, by integrally forming it in an approximately U-shape, it is possible to prevent the formation of any clearance between the heating plate 40A and the side walls W of the melting chamber 20 and possible to prevent leakage of the molten material from inside the melting chamber 20. Furthermore, it is possible to make the side walls W of the melting chamber 20 a heat resistant plate better in heat conductivity than the wall sections 41 and 41 of the heating plate 40A, so it is possible to efficiently perform preheating from both the side walls W of the melting chamber 20 and the bottom side of the heating plate 20.

Further, in the metal melting furnace 10B, as shown in FIGS. 5 and 6, a discharge section 80A which is communicated with the molten material holding chamber 90 is disposed. At the discharge section 80A, an auxiliary heater 85 is provided for holding the temperature of the molten material M. The auxiliary heater 85 can be used to hold the temperature of the molten material M without allowing it to burn, so oxidation of the molten material M is suppressed and the metal loss can be reduced. In addition, temperature control of the molten material M becomes easy and the burden on the heating burner 50 and holding burner 85 can be lightened to reduce the fuel consumption.

Figure 8:
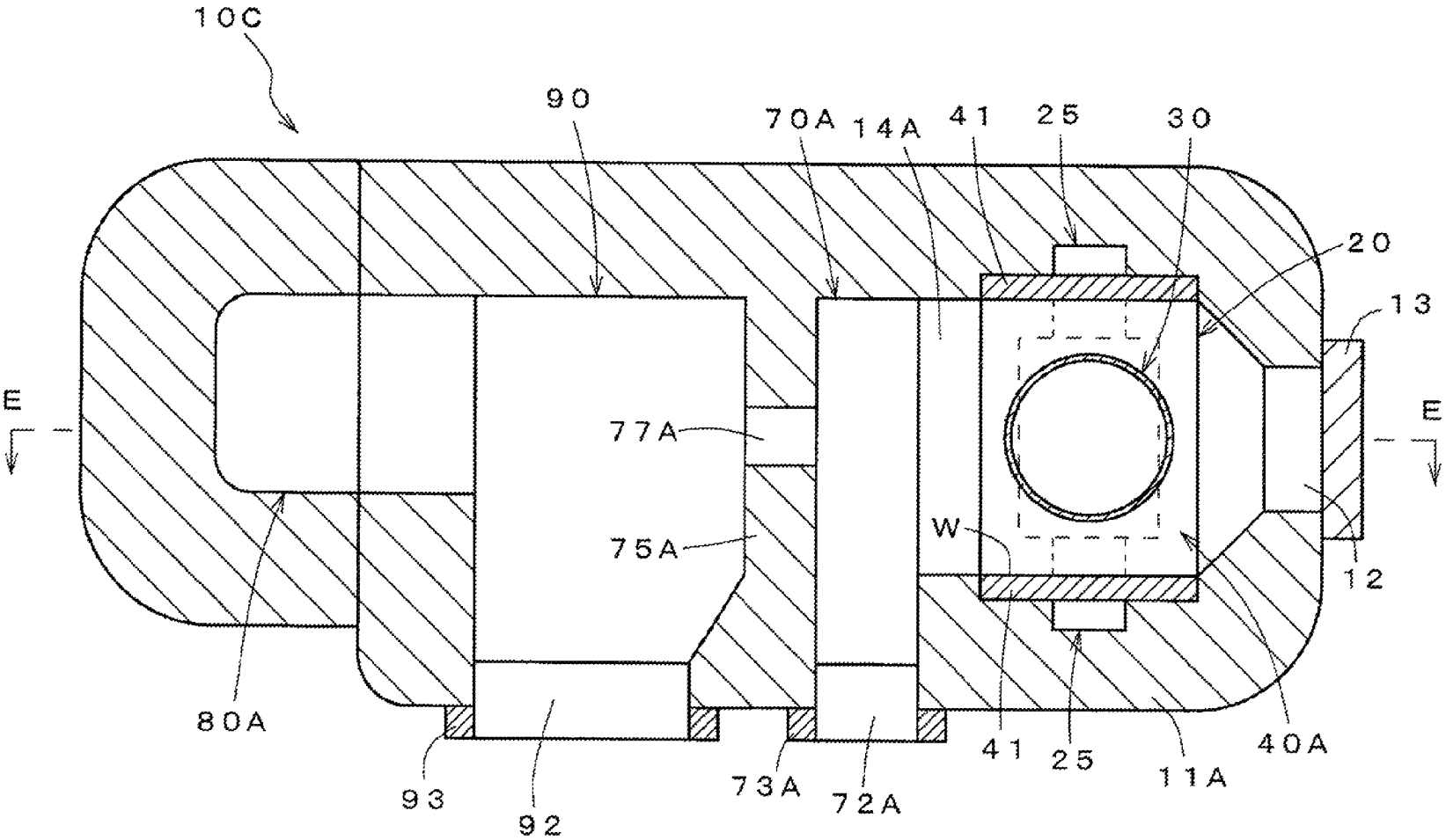
FIG. 8 is an overall schematic cross-sectional view of a metal melting furnace according to a fourth embodiment.
Figure 9:
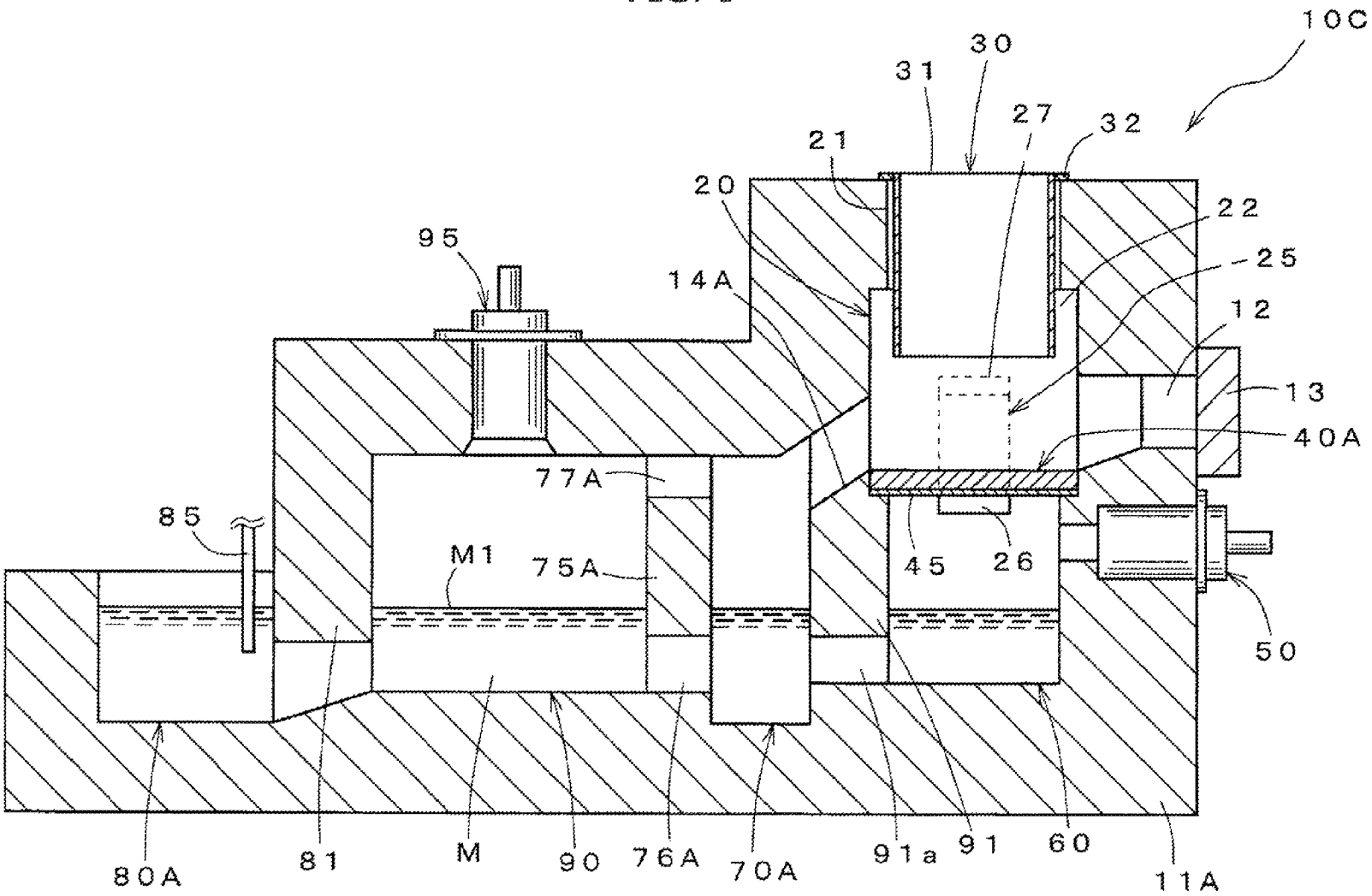
FIG. 9 is a longitudinal cross-sectional view along the line E-E of FIG. 8.
Figure 10:
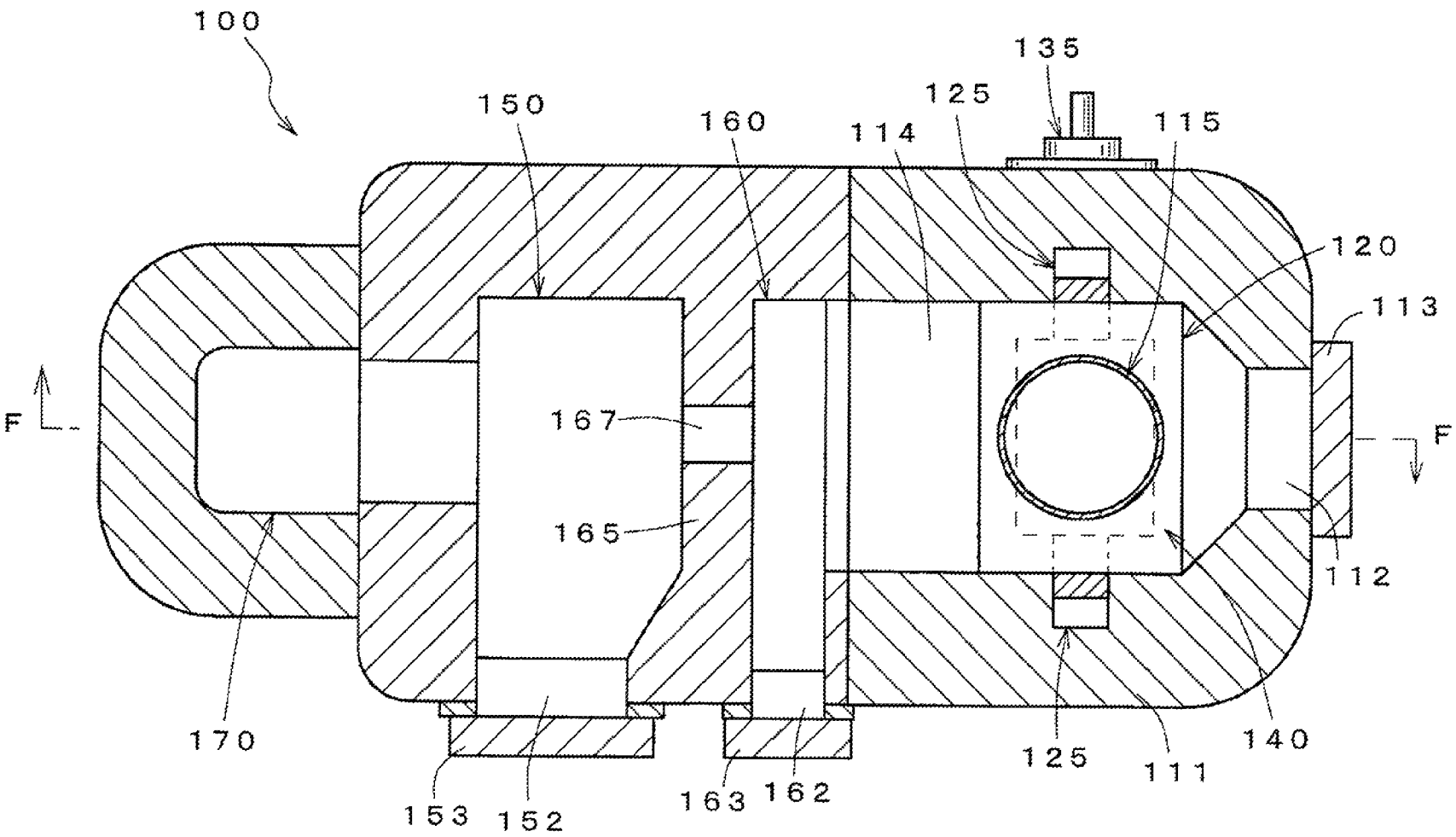
FIG. 10 PRIOR ART
FIG. 10 is an overall schematic cross-sectional view of a conventional metal melting furnace.
Figure 11:
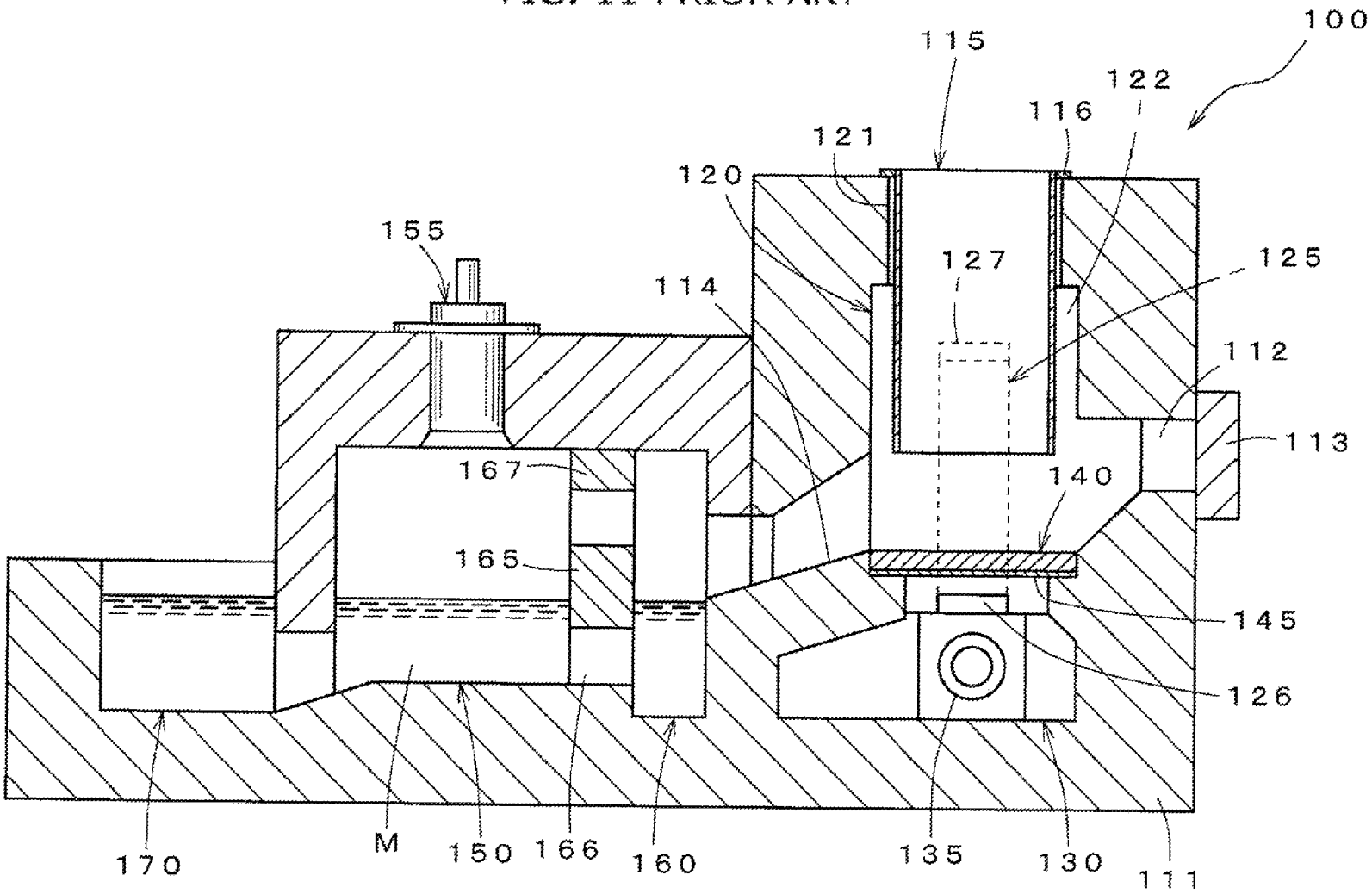
FIG. 11 PRIOR ART
FIG. 11 is a longitudinal cross-sectional view along the line F-F of FIG. 10.

A metal melting furnace 10C according to a fourth embodiment which is shown in FIGS. 8 and 9 is provided with a partition section 75A at the melting chamber side which defines the molten material holding chamber 90 whereby a molten material processing section 70A is formed. In the figure, reference notation 72A indicates a work inspection hole of the molten material processing section 70A, while 73A indicates a door of the same.

The molten material processing section 70A is a space which is interposed between the molten material holding chamber 90 and the melting chamber 20 and molten material holding section 60 and once stores the molten material M from the inclined floor 14A and the molten material M from the molten material holding section 60 without allowing it to directly flow into the molten material holding chamber 90 and is formed with a molten material communicating section 76A which connects the molten material holding section 60 and the molten material holding chamber 90 at the lower part of the partition section 75A. The molten material processing section 70A is configured so that the partition section 75A prevents the top surface M1 of the molten material M in the molten material processing section 70A from flowing into the molten material holding chamber 90, so can prevent the inflow of impure molten material from the inclined floor 14 and the molten material holding section 60. Further, as illustrated, the bottom side of the molten material communicating section 76A is provided at a position higher than the bottom surface of the molten material processing section 70A, so even if there are heavy metals etc. in the impurities which settle in the molten material and deposit on the bottom surface over a long period of time, they can be prevented from flowing into the molten material holding chamber 90.

Furthermore, at the upper part of the partition section 75A, a second exhaust gas channel 77A which circulates exhaust gas of the holding burner 95 of the molten material holding chamber 90 to the melting chamber 20 is formed. The second exhaust gas channel 77A is a passage for making the exhaust gas from the holding burner 95 of the molten material holding chamber 90 circulate through the furnace as a whole to effectively utilize it. That is, the exhaust gas of the holding burner 95 passes through the second exhaust gas channel 77A, then passes over the inclined floor 14A, circulates through the inside of the melting chamber 20, and is exhausted to the outside from the material charging port 21 which serves also as an exhaust port. Due to this, the exhaust gas from the molten material holding chamber 90 runs through the furnace as a whole and not only holds the temperature of the molten material M inside the molten material holding chamber 90, but also can preheat the melting material on the heating plate 40 in an auxiliary basis and therefore can more efficiently heat and melt it and can lighten the burden on the heating burner 50 and improve the fuel consumption. Note that, the second exhaust gas channel 77A is needless to say formed at a position higher than the top surface M1 of the molten material M.

Further, in the metal melting furnace 10C of the fourth embodiment, in the same way as the metal melting furnace 10B, a discharge section 80A which is communicated with the molten material holding chamber 90 is disposed. In accordance with need, an auxiliary heater 85 for holding the temperature of the molten material M is provided at the discharge section 80A.

As illustrated and explained above, in the metal melting furnace 10 of the present invention, the heating burner 50 is disposed at the bottom side of the heating plate 40 of the melting chamber 20, the heating burner 50 is used to melt the melting material on the heating plate 40, the exhaust gas of the heating burner 50 which runs through the exhaust gas channel 25 preheats the melting material in the flue 22 and, at the same time, at the bottom side of the heating burner 50 of the melting chamber 20, and a molten material holding section 60 into which the molten material M which was melted on the heating plate 40 flows down to be stored is formed so the molten material M is held in temperature by the heating burner 50, so a single heating burner 50 can be used to simultaneously preheat the melting material on the heating plate 40 and the molten material M which is stored at the molten material holding section 60. Therefore, it becomes possible to jointly use the heating burner 50 for the burner for heating and melting of the melting material and the burner for holding the temperature of the molten material M and possible to greatly reduce the fuel consumption during operation of the metal melting furnace 10.

Further, if forming, between the inclined floor 14 of the molten material M which was melted on the heating plate 40 and the molten material holding section 60, a molten material processing section 70 which has a partition section 75 which is provided with a molten material communicating section 76 at its bottom so as to prevent the top surface M1 of the molten material M which was melted at the melting chamber 20 from directly flowing into the molten material holding section 60, the impure molten material can be collected at the top surface M1 of the molten material M and only the clean molten material M can be made to flow into the molten material holding section 60 through the molten material communicating section 76 of the lower part of the partition section 75. Therefore, it is possible to raise the cleanliness of the molten material in the molten material holding section 60 to hold the quality high, the work of removal of the impurities is simplified, and the work efficiency is improved.

Furthermore, by disposing the discharge section 80 so as to communicate with the molten material holding section 60 and providing an auxiliary heater for holding the temperature of the molten material M at the discharge section 80, it becomes possible to hold the temperature without allowing the molten material M to burn, so oxidation of the molten material is suppressed and the metal loss is reduced and, in addition, temperature control of the molten material becomes easy and the burden on the heating burner can be lightened so the fuel consumption is reduced.

In addition, if disposing a second heating burner 55 for heating the melting material on the heating plate 40 at the upper side of the heating plate 40 of the melting chamber 20, it becomes possible to efficiently preheat the melting material and possible to lighten the burden on the heating burner 50 and it becomes possible to more effectively prevent the formation of unmelted or half-melted material.

On the other hand, if providing the molten material holding chamber 90 which communicates with the molten material holding section 60, stores the molten material M, and uses a holding burner 95 to hold the temperature of the molten material M, it becomes possible to store a large amount of molten material M, even when a large amount of molten material is stored, the molten material M can be preheated and efficiently held in temperature at both the molten material holding section 60 and the molten material holding chamber 90, and the fuel consumption during operation can be reduced.

Further, the partition section 75A at the melting chamber side which defines the molten material holding chamber 90, the molten material communicating section 76A which communicates with the molten material holding section 60 is formed at the lower part, so the impure molten material collects at the top surface M1 of the molten material M and only clean molten material M can be made to flow through the molten material communicating section 76A at the lower part of the partition section 75A to the molten material holding chamber 90, the cleanliness of the molten material in the molten material holding chamber is raised, the quality can be held high, and the work of removing impurities is simplified so the work efficiency is improved. In addition, at the upper part of the partition section 75A, a second exhaust gas channel 77A which circulates exhaust gas of the holding burner 95 of the molten material holding chamber 90 to the melting chamber 20 is formed, so the exhaust gas from the molten material holding chamber 90 is circulated through the furnace as a whole and therefore can preheat the melting material on the heating plate 40 in an auxiliary manner and can lighten the burden on the heating burner to improve the fuel economy.

Furthermore, by disposing a discharge section 80A so as to communicate with the molten material holding chamber 90 and providing an auxiliary heater at the discharge section 80A to hold the temperature of the molten material M, it becomes possible to hold the temperature without allowing the molten material M to burn, so the oxidation of the molten material is suppressed and the metal loss is reduced. In addition, temperature control of the molten material becomes easy and the burden of the heating burner can be lightened to reduce the fuel consumption.

Note that, the metal melting furnace of the present invention is not limited to the configurations explained in the above embodiments. It also possible to work the invention by making various changes in a range not deviating from the gist of the invention. For example, in the embodiments, the melting material holding member was made a tubular member comprised of a stainless steel material which was coated with alumina (heat-resistant cast steel), but the invention is not limited to this. It is also possible to use silicon carbide (SiC) or graphite mixtures. It may also be formed by any of a porous member or mesh member or a frame member.

Further, in the first and second embodiments, a flat shaped heating plate was used, but it is also possible to use the substantially U-shaped heating plate which was used in the third and fourth embodiments. Similarly, it is also possible to use a flat shaped heating plate in the third and fourth embodiments.

What is claimed is:

1. A metal melting furnace which has a material charging port and a flue at its top and a melting chamber with a heating plate which melts a melting material charged from said material charging port at its bottom, said metal melting furnace characterized in that a heating burner is disposed at a bottom side of said heating plate of said melting chamber, said heating burner is used to melt said melting material on said heating plate, exhaust gas of said heating, burner which circulates through an exhaust gas channel is used to preheat the melting material of said flue, at a bottom side of said heating burner of said melting chamber, a molten material holding section is formed, to which molten material melted on said heating plate flows down into to be stored, and said heating burner is used to hold the temperature of said molten material.

2. The metal melting furnace according to claim 1, wherein a molten material processing section is formed between an inclined floor and said molten material holding section, said molten material processing section having a partition section which is provided with a molten material communicating section at a lower part, and wherein a top surface of the molten material which was melted at said melting chamber is prevented from directly flowing into said molten material holding section.

3. The metal melting furnace according to claim 1, wherein a discharge section is provided to communicate with said molten material holding section, said discharge section having an auxiliary heater for holding the temperature of said molten material.

4. The metal melting furnace according to claim 1, wherein a second heating burner is disposed at a top side of said heating plate of said melting chamber for heating the melting material on said heating plate.

5. The metal melting furnace according to claim 1, wherein a molten material holding chamber is provided to (1) communicate with said molten material holding section, (2) store said molten material, and (3) use a holding burner to hold the temperature of said molten material.

6. The metal melting furnace according to claim 5, wherein a partition section at a side of said melting chamber is provided to define the molten material holding chamber, wherein said partition section is formed with a molten material communicating section at a lower part which communicates with said molten material holding section, and wherein said partition section is formed with a second exhaust gas channel at an upper part which circulates exhaust gas from said molten material holding chamber to said melting chamber.

7. The metal melting furnace according to claim 5, wherein a discharge section is provided to communicate with said molten material holding chamber, said discharge section having an auxiliary heater for holding the temperature of said molten material.

* * * * *